US011162234B2

(12) United States Patent
Neusch

(10) Patent No.: US 11,162,234 B2
(45) Date of Patent: Nov. 2, 2021

(54) ANTI-RAM PASSIVE VEHICLE BARRIER

(71) Applicant: NEUSCH INNOVATIONS, LP, Marble Fall, TX (US)

(72) Inventor: William H. Neusch, Marble Falls, TX (US)

( * ) Notice: Subject to any disclaimer, the term of this patent is extended or adjusted under 35 U.S.C. 154(b) by 0 days.

(21) Appl. No.: 16/167,260

(22) Filed: Oct. 22, 2018

(65) Prior Publication Data

US 2019/0063020 A1 Feb. 28, 2019

Related U.S. Application Data

(63) Continuation of application No. 15/135,400, filed on Apr. 21, 2016, now Pat. No. 10,106,939.

(60) Provisional application No. 62/151,370, filed on Apr. 22, 2015, provisional application No. 62/165,163, filed on May 21, 2015.

(51) Int. Cl.
*E01F 13/12* (2006.01)
*E01F 15/00* (2006.01)

(52) U.S. Cl.
CPC ..... *E01F 13/12* (2013.01); *E01F 15/00* (2013.01)

(58) Field of Classification Search
CPC ..... E01F 15/00; E01F 15/003; E01F 15/04; E01F 15/14; E01F 15/145; E01F 15/146; E01F 15/148; E01F 13/00
USPC ..... 404/6
See application file for complete search history.

(56) References Cited

U.S. PATENT DOCUMENTS 1,222,020 A * 4/1917 Myers ..... E01F 13/02 182/181.1
1,658,118 A * 2/1928 Doddridge ..... E01F 15/0476 256/13.1
1,826,998 A * 10/1931 Doddridge ..... E01F 15/0476 256/13.1

(Continued)

FOREIGN PATENT DOCUMENTS

DE 4031781 A1 4/1991
DE 4335904 A1 5/1995

(Continued)

OTHER PUBLICATIONS

International Search Report and Written Opinion, PCT/US2016/028690, dated Jul. 15, 2016.

(Continued)

*Primary Examiner* — Thomas B Will
*Assistant Examiner* — Katherine J Chu
(74) *Attorney, Agent, or Firm* — Shackelford, Bowen, McKinley & Norton, LLP; Henry Ehrlich

(57) ABSTRACT

A vehicle barrier includes a longitudinally extending beam positioned vertically above and off of a ground level and separating a protected side from an attack side, the beam comprising beam sections, a post positioned in a same vertical plane as the beam and supporting the beam off of the ground level, wherein adjacent beam sections are pivotally connected to the post, wherein the post is an I-beam having a central web, a beam connector plate having first and second vertical holes, the beam connector plate disposed through the central positioning the first and second vertical holes on opposite sides of the central web, and the adjacent beam sections connected to the beam connector plate on opposite sides of the central web.

20 Claims, 13 Drawing Sheets

(56) References Cited

U.S. PATENT DOCUMENTS 1,848,246 A * 3/1932 Dowell ..... E01F 15/0446 256/13.1
1,849,167 A * 3/1932 Bente ..... E01F 15/0423 256/13.1
1,922,878 A * 8/1933 Boyle ..... E01F 15/0438 256/13.1
1,956,767 A * 5/1934 Kibler ..... E04H 17/003 256/21
2,073,947 A * 3/1937 Sander ..... E04H 17/18 256/24
1,749,190 A 4/1938 McGregor
2,123,167 A * 7/1938 Cain ..... E01F 15/0461 256/13.1
2,265,698 A * 12/1941 Opgenorth ..... E01F 15/06 116/202
2,777,227 A * 1/1957 Imhoff ..... E04H 17/10 160/160
3,210,051 A * 10/1965 Case ..... E01F 15/06 256/13.1
3,258,250 A * 6/1966 Mcmullin ..... E01D 19/103 256/13.1
3,417,965 A * 12/1968 Gray ..... E01F 15/0415 256/13.1
3,447,786 A 6/1969 Bigni
3,589,681 A * 6/1971 Ackerman ..... E01F 15/143 256/13.1
3,726,750 A 4/1973 Stillings
3,784,167 A * 1/1974 Glaesener ..... E01F 15/0453 256/13.1
4,474,503 A * 10/1984 Booth ..... E01F 15/006 116/63 R
4,739,971 A * 4/1988 Ruane ..... E01F 15/0453 114/219
4,778,250 A * 10/1988 McRoskey ..... E01F 13/02 256/64
4,784,515 A * 11/1988 Krage ..... E01F 15/143 256/13.1
4,806,044 A * 2/1989 Duckett ..... E01F 15/006 16/361
4,979,817 A * 12/1990 Crisp, Sr. ..... E01F 15/025 256/13.1
5,664,905 A * 9/1997 Thompson ..... E01D 19/103 248/548
5,720,470 A 2/1998 Johansson
6,059,487 A * 5/2000 Haga ..... E01F 15/0476 256/13.1
6,254,063 B1 * 7/2001 Rohde ..... E01F 15/0461 256/1
6,272,796 B1 * 8/2001 Metzler ..... F16B 7/00 52/93.1
6,290,427 B1 * 9/2001 Ochoa ..... E01F 15/0423 256/13.1
6,398,192 B1 * 6/2002 Albritton ..... E01F 15/0461 256/13.1
6,413,009 B1 * 7/2002 Duckett ..... E01F 15/083 404/6
6,485,224 B1 * 11/2002 Dyke ..... E01F 15/006 16/250
6,488,268 B1 * 12/2002 Albritton ..... E01F 15/0461 256/13.1
6,533,249 B2 * 3/2003 Ochoa ..... E01F 15/0423 256/13.1
6,551,011 B1 * 4/2003 Valentine ..... E01F 15/0476 256/13.1
6,644,888 B2 * 11/2003 Ochoa ..... E01F 15/0438 404/6
6,666,616 B2 * 12/2003 Yodock, III ..... E01F 15/083 256/13.1
6,729,607 B2 * 5/2004 Alberson ..... E01F 15/0461 256/13.1
6,783,116 B2 * 8/2004 Albritton ..... E01F 15/143 256/13.1
6,843,613 B2 * 1/2005 Gelfand ..... B61L 29/08 244/110 C
6,932,327 B2 8/2005 Alberson et al.
7,144,186 B1 12/2006 Nolte
7,367,549 B2 * 5/2008 Titmus ..... E01F 15/06 256/13.1
7,530,548 B2 * 5/2009 Ochoa ..... E01F 15/0423 256/13.1
7,544,009 B2 * 6/2009 Bergendahl ..... E01F 15/025 256/13.1
7,581,351 B2 * 9/2009 Lewis ..... E01F 13/048 404/6
7,794,173 B2 * 9/2010 Amengual Pericas ..... E01F 15/0438 256/13.1
7,866,106 B2 * 1/2011 Bowlware ..... E01F 13/12 404/6
7,866,913 B2 * 1/2011 Kulp ..... E01F 15/088 256/13.1
7,878,485 B2 * 2/2011 Conway ..... E01F 15/0461 256/13.1
7,913,981 B2 * 3/2011 Rohde ..... H01R 13/506 256/13.1
7,950,870 B1 * 5/2011 Thompson ..... E01F 13/12 256/13.1
7,988,133 B2 * 8/2011 Gripne ..... E01F 15/025 256/13.1
7,997,824 B2 * 8/2011 Amengual Pericas ..... E01F 15/0453 404/6
8,001,880 B2 * 8/2011 White ..... E01F 15/083 89/36.04
8,033,053 B2 * 10/2011 Anderson ..... E01F 13/048 404/6
8,083,433 B2 12/2011 Neusch
8,127,419 B2 * 3/2012 Calton ..... E04H 17/1413 29/402.09
8,210,767 B1 * 7/2012 Swahlan ..... F41H 11/08 256/1
8,235,359 B2 * 8/2012 Dyke ..... E01F 15/146 256/13.1
8,439,594 B1 * 5/2013 Clark ..... E01F 13/12 256/13.1
8,517,349 B1 * 8/2013 Ross ..... E01F 15/143 256/13.1
8,596,617 B2 * 12/2013 James ..... E01F 15/025 256/13.1
9,347,191 B2 * 5/2016 Kemper ..... E01F 15/0461
9,410,298 B2 8/2016 Kemper et al.
9,428,872 B2 * 8/2016 Neusch ..... E01F 13/12
9,435,088 B2 9/2016 Kemper et al.
9,719,220 B2 * 8/2017 Neusch ..... E01F 13/12
10,047,488 B2 * 8/2018 Leonhardt ..... E01F 15/02
10,208,430 B1 * 2/2019 Lawler ..... E01B 5/18
10,767,325 B2 * 9/2020 Humphries ..... E01F 15/088
2003/0081997 A1 * 5/2003 Kramer ..... E01F 15/145 404/6
2003/0089066 A1 * 5/2003 Nelson ..... E04B 2/763 52/424
2003/0146426 A1 * 8/2003 Ray ..... A01K 3/00 256/59
2005/0191125 A1 * 9/2005 Albritton ..... E01F 15/0423 404/6
2005/0199868 A1 * 9/2005 Morris ..... E04F 11/1836 256/73
2006/0002760 A1 * 1/2006 Vellozzi ..... B61L 29/08 404/6
2006/0011900 A1 * 1/2006 Ochoa ..... E01F 15/0423 256/13.1
2007/0102689 A1 * 5/2007 Alberson ..... E01F 15/06 256/13.1
2008/0131200 A1 * 6/2008 Winkler ..... E01F 13/12 404/6
2012/0056143 A1 * 3/2012 James ..... E01F 15/06 256/13.1

(56) References Cited

U.S. PATENT DOCUMENTS

| | | | | |
|---|---|---|---|---|
| 2012/0207541 | A1* | 8/2012 | Maus | E01F 15/086 404/6 |
| 2014/0110651 | A1* | 4/2014 | Cox | E01F 15/04 256/13.1 |
| 2015/0346060 | A1* | 12/2015 | Simon | E01F 15/14 404/6 |
| 2016/0017555 | A1 | 1/2016 | Kemper et al. | |
| 2016/0053449 | A1 | 2/2016 | Kemper et al. | |
| 2016/0115661 | A1* | 4/2016 | Neusch | E01F 13/123 404/6 |
| 2016/0230358 | A1 | 8/2016 | Kemper et al. | |
| 2018/0327985 | A1* | 11/2018 | Lawler | E01F 15/0453 |
| 2019/0085589 | A1* | 3/2019 | McKinney | E04H 17/1426 |
| 2019/0186092 | A1* | 6/2019 | Neusch | E01F 13/12 |
| 2021/0115635 | A1* | 4/2021 | Delot | E01F 15/06 |

FOREIGN PATENT DOCUMENTS

| | | | |
|---|---|---|---|
| EP | 0369659 | A1 | 5/1990 |
| GB | 2224529 | A | 5/1990 |
| GB | 2481647 | A | 4/2012 |

OTHER PUBLICATIONS

U.S. Dept. of State, DS-41 K-4 Anti-Ram Fence Details, Feb. 4, 2010.
Baker, Vehicle Fence Type 1 Gate, Apr. 3, 2008.
Baker, Personnel-Vehicle Type 2A, Nov. 4, 2007.
Baker, Vehicle Fence Type 1, Apr. 21, 2008.
ASTM Designation F 2656-07, Standard Test Method for Vehicle Crash Testing of Perimeter Barriers.
Stallwart Post & Rail Anti-Ram Crash Barrier; Ameristar Fence Products; Jun. 2014.
Ameristar Stalwart M50-P1 Single Run Layout; dated May 4, 2015.
Ameristar Stalwart K12 Post and Rail; dated May 4, 2015.
Ameristar Stallwart M40 P2 Post and Rail; dated May 5, 2015.
DOS SD-STD-02.01, Revision A Draft, Test Method for Vehicle Crash Testing of Perimeter Barriers and Gates, Jan. 2003.

* cited by examiner

ANTI-RAM PASSIVE VEHICLE BARRIER

BACKGROUND

This section provides background information to facilitate a better understanding of the various aspects of the disclosure. It should be understood that the statements in this section of this document are to be read in this light, and not as admissions of prior art.

Anti-ram vehicle barrier systems are used to guard against access to protected areas. In particular, the systems are provided to stop motor vehicles, such as trucks, from being intentionally driven into certain areas for nefarious purposes. At least one agency of the United States Government has provided standards to certify barriers for use.

SUMMARY

An exemplary vehicle barrier includes a longitudinally extending beam positioned vertically above a ground level and separating a protected side from an attack side, the beam comprising beam sections, wherein adjacent beam sections are pivotally connected, and posts having a first end disposed below ground level and a second end attached to the beam. In some embodiments, the vehicle barrier is configured to achieve an ASTM F2656 designation capable of stopping a 15,000-pound vehicle impacting the beam when traveling in a direction from the attack side toward the protected side within a determined distance.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
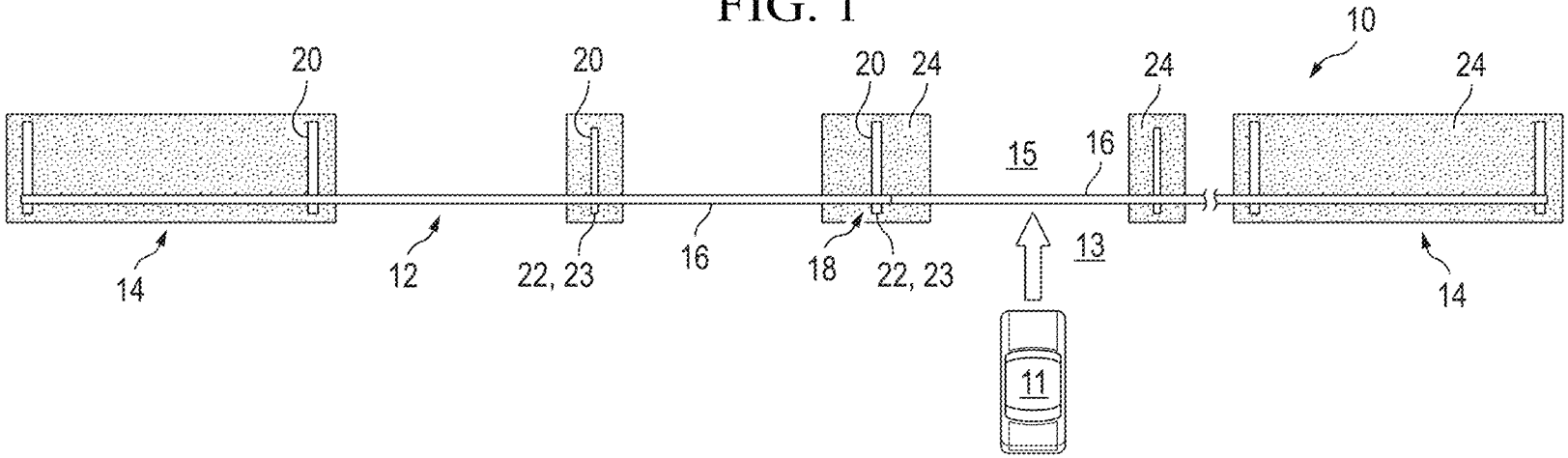
FIG. 1 is a plan view of a section of an exemplary anti-ram passive vehicle barrier according to aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

Figure 2:
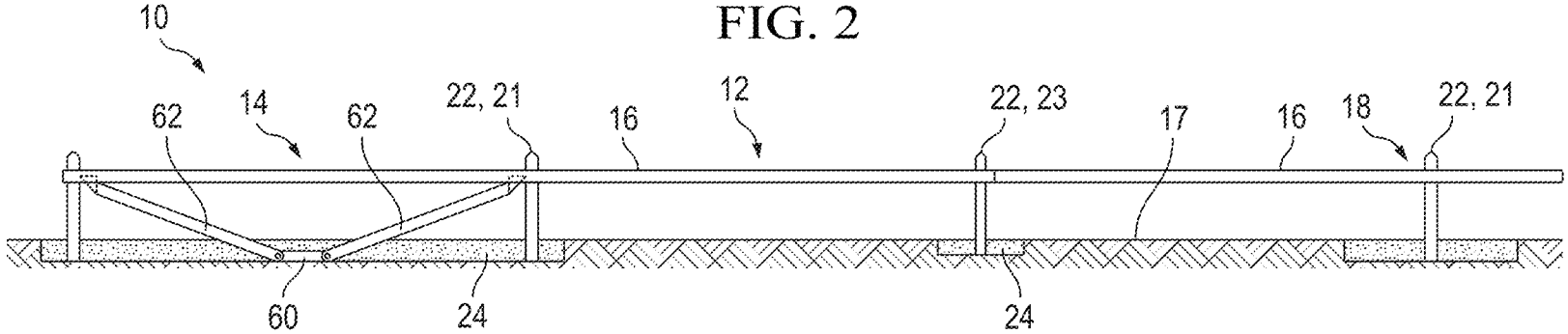
FIG. 2 is an elevation view of a portion of the exemplary anti-ram passive vehicle barrier of FIG. 1.
Figure 3:
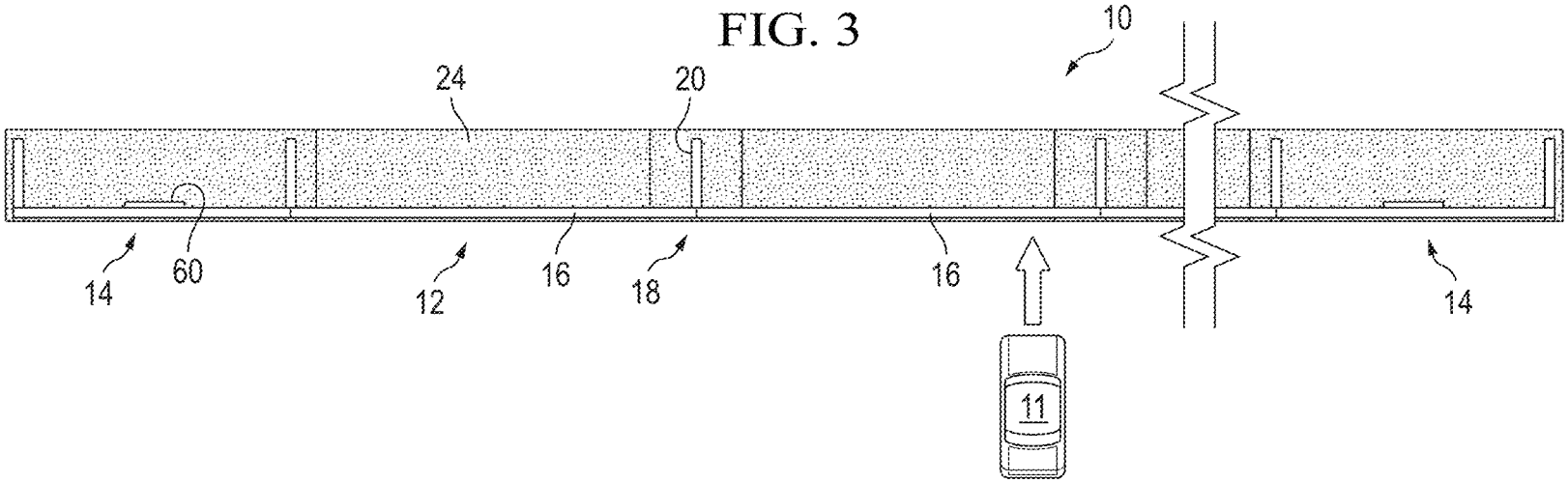
FIG. 3 is a plan view of a section of an exemplary anti-ram passive vehicle barrier according to aspects of the disclosure.
Figure 4:
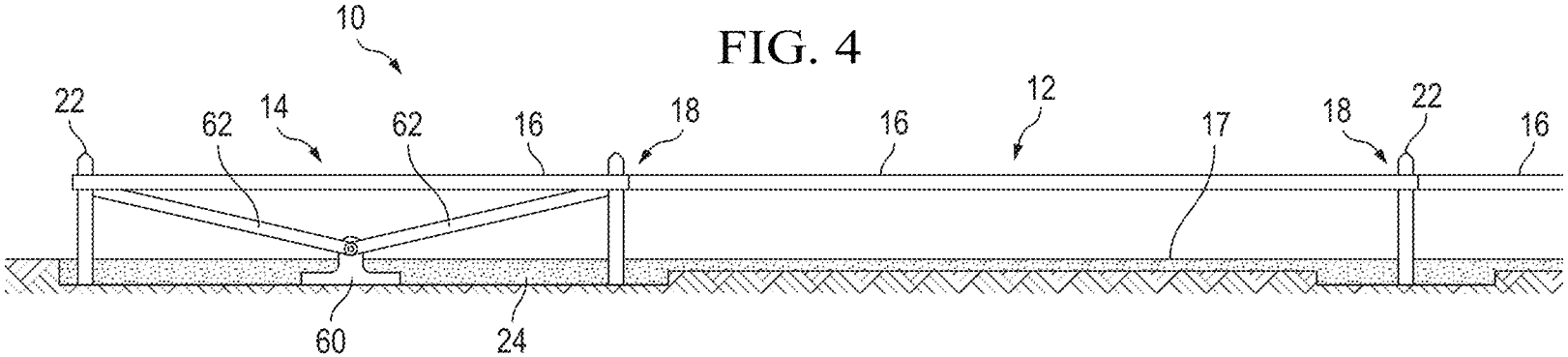
FIG. 4 is an elevation view of a portion of the exemplary anti-ram passive vehicle barrier of FIG. 3.

FIGS. 1 and 3 are plan views of examples of sections of a passive vehicle barrier (PVB), generally denoted by the numeral 10, according to aspects of this disclosure. FIGS. 2 and 4 are elevation views from an attack side of the PVBs illustrated respectively in FIGS. 1 and 3.

PVB 10 is configured to stop the penetration of a motor vehicle that crashes into the barrier. PVB 10 should fully stop any impacting vehicle within a desired penetration distance, for example, to keep explosives carried by the vehicle at a selected standoff distance from facilities located within the barrier perimeter. United States federal agencies (e.g., the U.S. Department of Defense (DOD) and the Department of State (DOS)) have developed test standards using crash tests to quantify, verify, and certify barrier performance. Such test methods were initially published by the U.S. Dept. of State in 1985 as SD-STD-02.01, which was revised in 2003 as SD-STD-02.01 Revision A, and which was replaced in 2009 with ASTM F2656 (Standard Test Method for Vehicle Crash Testing of Perimeter Barriers). Embodiments of PVB 10 are configured to be crash-rated by certifying agencies such as DOD, DOS, ASTM and British Standards (BSI). Vehicle barriers are tested by crashing a motor vehicle from a perpendicular direction into the barrier.

The vehicle barrier is rated based on the test vehicles weight, the speed of impact, and the penetration of the vehicle (e.g., the cargo bed) beyond the pre-impact inside edge of the barrier. For example, a "K" or "M" designates a medium duty vehicle with a gross weight of 15,000 pounds (6810 kg). The speed ratings include K4/M30 for traveling at 28.0 to 37.9 miles per hour (mph), K8/M40 traveling at 38.0 to 46.9 mph, and K12/M50 traveling at 47.0 mph and above. The penetration ratings include P1 for less than or equal to 1 meter (3.3 ft.), P2 for 1.10 to 7 m (3.31 to 23.0 ft.), and P3 for 7.01 to 30 m (23.1 to 98.4 ft.). For example, an M50 P1 crash barrier is designed to stop a medium duty truck traveling 50 mph with a penetration distance of 3.3 feet or less.

In FIGS. 1 and 3, PVB 10 is positioned between a protected side 15 and a motor vehicle 11 approaching PVB 10 from an attack side 13. According to aspects of the disclosure, PVB 10 is configured to achieve a crash rating. In some embodiments, PVB 10 is configured to achieve a crash rating of M50 P1. In some embodiments, PVB 10 is configured to achieve a crash rating based upon a motor vehicle 11 impacting the barrier in a span of the beam between adjacent line posts or adjacent braces.

PVB 10 includes a continuous beam 12 positioned above ground level 17. For example, beam 12 may be supported approximately three feet off of ground level 17. PVB 10 may include one or more truss sections 14. In the illustrated examples, truss sections 14 are illustrated at terminal ends of a longitudinal length of continuous beam 12, however, truss sections 14 may be positioned within a longitudinal span of continuous beam 12. Beam 12 is formed of interconnected beam sections 16. Adjacent beams sections 16 are connected at joints 18. Joints 18 are pivoting connections that permit a degree of pivoting movement between adjacent beam sections 16 or a beam section and a post when beam 12 is impacted by a motor vehicle. Examples of pivot connections at joints 18 are illustrated in FIGS. 6A-6C, 7, and 10-15.

Posts, generally denoted by the numeral 22, are connected to beam 12, for example, to support beam 12 above ground level and to provide tension to mitigate lift of beam 12 in response to the impact of the motor vehicle. Posts 22 are metal members and may take various forms including I-beams, round or rectangular (e.g., square) members. Posts 22 may be arranged in a line post configuration, identified specifically with reference number 21, connected to beam 12 at a joint 18. Posts 22 may be arranged in an intermediate configuration, identified specifically with reference number 23, connected to beam 12 at an intermediate position in between joints 18. Some or all of posts 22 may be used to support an ornamental fence structure, e.g. a chain link section.

Figure 5A:
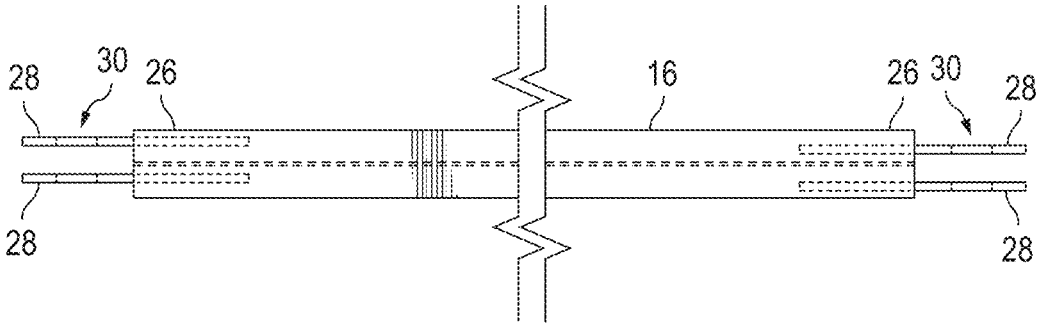
FIGS. 5A and 5B are views of an exemplary beam section.
Figure 5B:
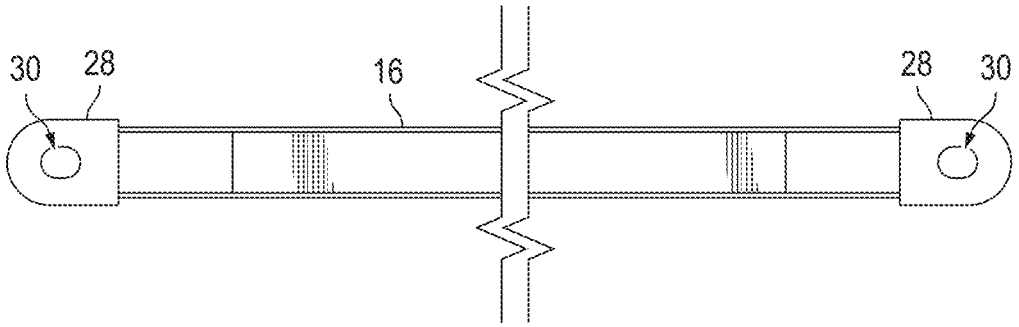

FIGS. 5A and 5B illustrate an exemplary beam section 16. Beam section 16 is a metal member, for example, an I-beam, for example, a wide flange beam or W-beam, extending between opposing terminal ends 26. Beam section 16 may be provided in different lengths. For example, in FIGS. 1 and 2, beam sections 16 may be forty feet and in FIGS. 3 and 4 beam sections 16 may be for example twenty or thirty feet in length. The dimensions described are non-limiting examples. A beam plate 28, e.g., connector, having a central aperture or hole 30 is attached at each terminal end 26. Two beam plates 28 are spaced apart vertically and attached at each terminal end 26 with the respective holes 30 coaxially aligned to dispose a pin and pivotally connect adjacent beam section and/or pivotally attached a beam section to a post.

Figure 5C:
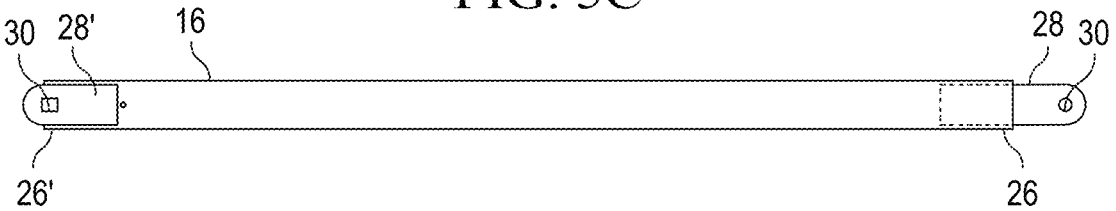
FIGS. 5C and 5D are views of an exemplary beam section.
Figure 5D:
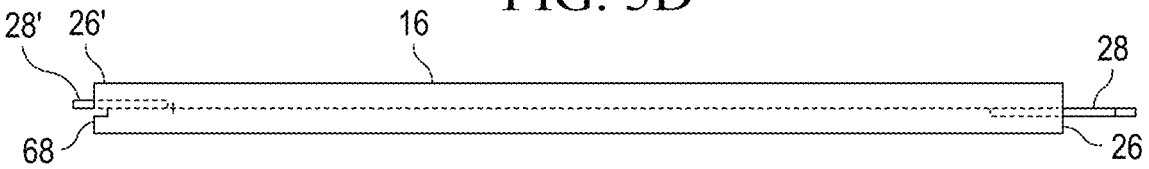

FIGS. 5C and 5D illustrate another exemplary beam section 16. In this example, beam section 16 is referred to a female-male beam section 16. Female-male beam section 16 has a female terminal end 26' on the left side carrying a female beam plate 28'. Exemplary female terminal end 26' has and a groove or slot 68 to receive a beam plate 28 of an adjacent beam section 16 or to receive an independent connector plate, see, e.g. FIGS. 5E-5H. The second terminal end 26 of the female-male beam section is a male end carrying a beam plate 28. In this example, male beam plate 28 extends a greater distance away from terminal end 26 than female beam plate 28' extends from terminal end 26'. In the illustrated example, female beam plate 28' has a square hole 30 as opposed to a circular hole 30 formed in the male beam plate 28. In some embodiments, beam section 16 may be a female-female section having female beam plate(s) 28' at both terminal ends or a male-male beam section illustrated for example in FIGS. 5A and 5B.

Figure 5E:
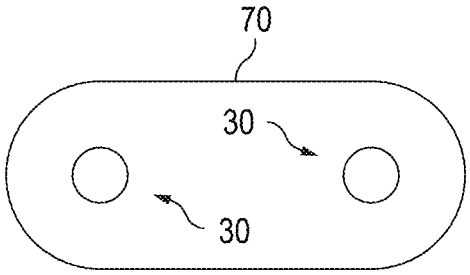
FIGS. 5E-5H illustrate exemplary connector plates to pivotally connect a beam section to a post and/or to an adjacent beam section.
Figure 5G:
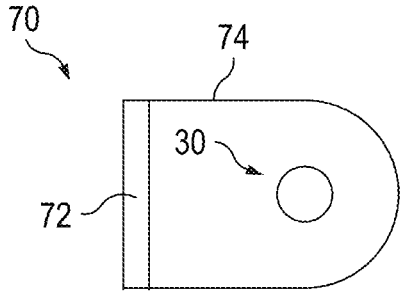
Figure 5F:
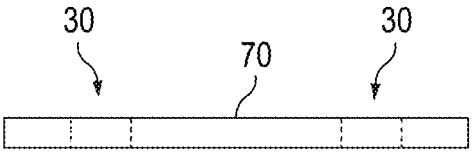
Figure 6A:
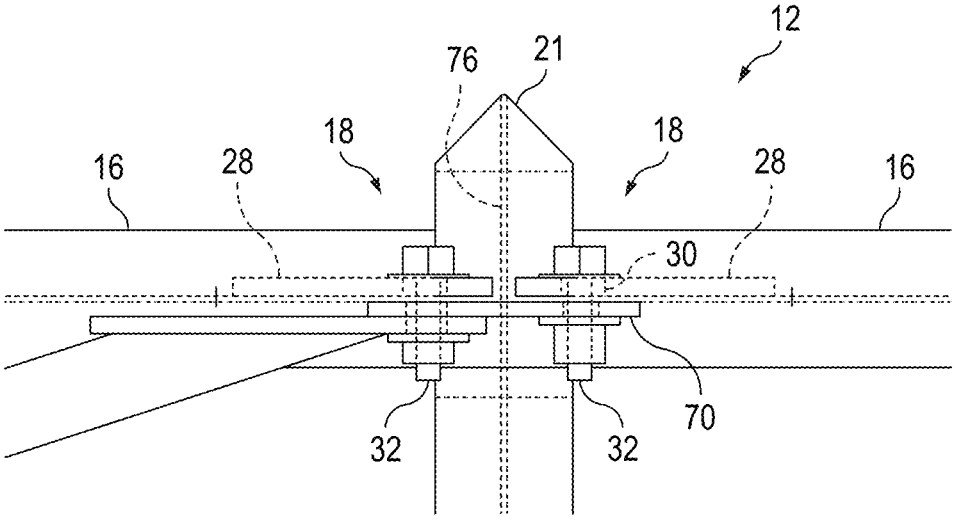
FIG. 6A illustrates an example of a pivotal connection of adjacent beam sections at a post.

FIGS. 5E and 5F illustrate an exemplary independent connector plate 70 configured for pivotally connecting adjacent beam sections for example at a post such as illustrated in FIG. 6A. In this example, connector 70 is a generally metal planar member having two holes 30 spaced apart and located on opposite sides of the planar connector plate 70.

Figure 5H:
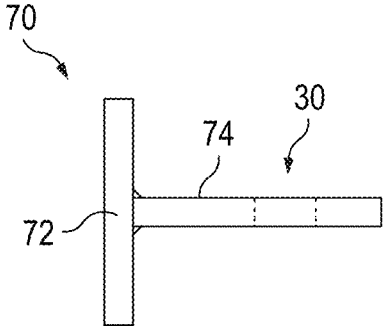
Figure 6B:
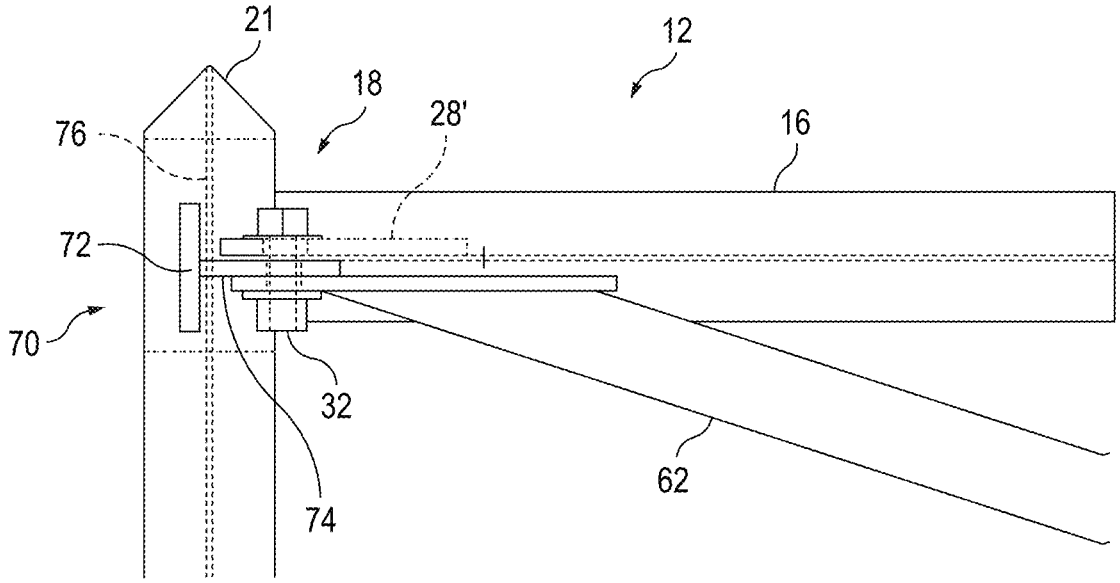
FIG. 6B illustrates another example of a pivotal connection of adjacent beam sections at a post.

FIGS. 5G and 5H illustrate an exemplary connector 70 configured for pivotally connecting a beam section to a post such as illustrated in FIG. 6B. In this embodiment, connector 70 is generally T-shaped having a first planar member 72 and a second planar member 74 extending in different planes perpendicular to one another. A hole 30 is formed through second planar member 74. With reference to FIG. 6B, in use the first planar member 72 extends in a vertical plane for connection with post 21, e.g., a web of the post, and the second planar member 74 extends in a horizontal plane away from post 21 with hole 30 oriented vertically for accepting a pin.

Figure 22:
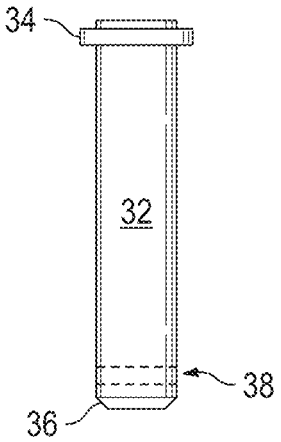
FIG. 22 illustrates an example of a pivot pin according to aspects of the disclosure.

FIG. 6A illustrates an example of adjacent beam sections 16 pivotally connected to each other at a line post 21. With additional reference to FIGS. 5E and 5F, connector 70 is connected to line post 21 with vertical holes 30 in connector 70 positioned on opposite sides of line post 21. For example, connector 70 is position in a web 76 of line post 21 with one hole 30 positioned on the left side of post 21 and the other hole 30 positioned on the right side of post 21. Left beam section 16 is positioned with hole 30 of beam plate 28 coaxial with one of the vertical holes 30 in connector 70 and right beam section 16 is positioned with hole 30 of beam plate 28 coaxial with the other one of the vertical holes 30 in connector 70. A pin 32 is positioned in coaxial holes 30 to create a pivoting connection at a joint 18, whereby adjacent beam sections 16 can pivot relative to one another and relative to line post 21 when beam 12 is impacted by a motor vehicle. In the illustrated example, pin 32 is in the form of a bolt with a securing nut. Another example of a pin 32 is illustrated in FIG. 22. Beam sections 16 each have a single beam plate 28 in FIG. 6A, however, beam sections 16 may have a two vertically spaced apart beam plates 28 as illustrated in FIGS. 5A and 5B.

FIG. 6B illustrates an example of a beam section 16 pivotally connected to a post 21 at a joint 18. With reference to FIGS. 5G and 5H, a connector 70 is attached to line post 21. For example, vertical member 72 of connector 70 is located on a first side of a center web 76 of post 21 with horizontal member 74 extending through center web 76 to a second side of post 21. Beam plate 28 of beam section 16 is positioned with connector 70 whereby a pin 32 pivotally attaches beam section 16 to post 21 at joint 18. In this example, a truss beam 62 is also attached at joint 18.

Figure 6C:
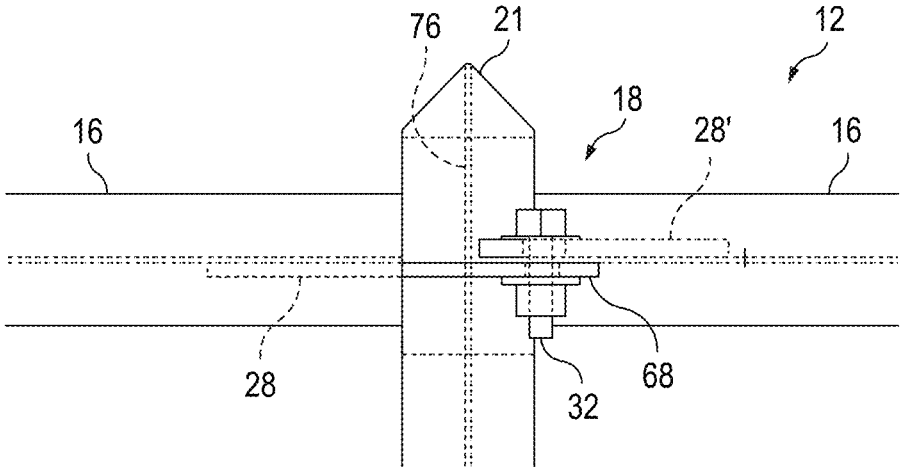
FIG. 6C illustrates another example of a pivotal connection of adjacent beam sections at a post.

FIG. 6C illustrates another example of a pivotal connection of adjacent beam sections 16 via a joint 18 at a line post 21. Beam plate 28, e.g. male beam plate 28, extends from beam section 16 on the left of post 21 through web 76 to the right side of post 21. Beam plate 28' of the right beam section 16 is positioned above beam plate 28 with their vertical holes coaxially aligned. A pin 32 is positioned in beam plates 28, 28' pivotally connecting adjacent beam sections 16 at joint 18.

With reference, in particular to FIGS. 7-18, some embodiments of PVB 10 include braces 20 attached to beam 12. Braces 20 are located on the protected side and have a first end attached to beam 12 and a second end secured in a foundation 24, whereby the foundation and the brace form two adjacent sides of a vertex having an acute angle. The brace and the foundation form a sled to absorb or counter the impact force of the vehicle 11. Braces 20 may be connected to beam 12 at joints 18 (see, e.g., FIGS. 7 and 10) and/or connected to beam 12 at intermediate positions between the joints 18 (see, e.g., FIG. 16). Although braces 20 are illustrated in FIGS. 1 to 4 as being located with posts 22, the braces may be located separately from a post.

Foundation 24 is concrete and may be a shallow or a deep foundation. A concrete foundation having a depth, for example, of about twenty inches or less, may be considered a shallow foundation. Concrete foundation 24 may be about eighteen inches or less. Concrete foundation 24 may be about twelve inches or less. Concrete foundation 24 may be about six inches or less. Concrete foundation 24 may extend the length of beam 12 as shown for example in FIGS. 3 and 4 or concrete foundation 24 may be provided only at selected locations, such as at line posts 21 and/or braces 20 as illustrated in FIGS. 1 and 2.

Figure 7:
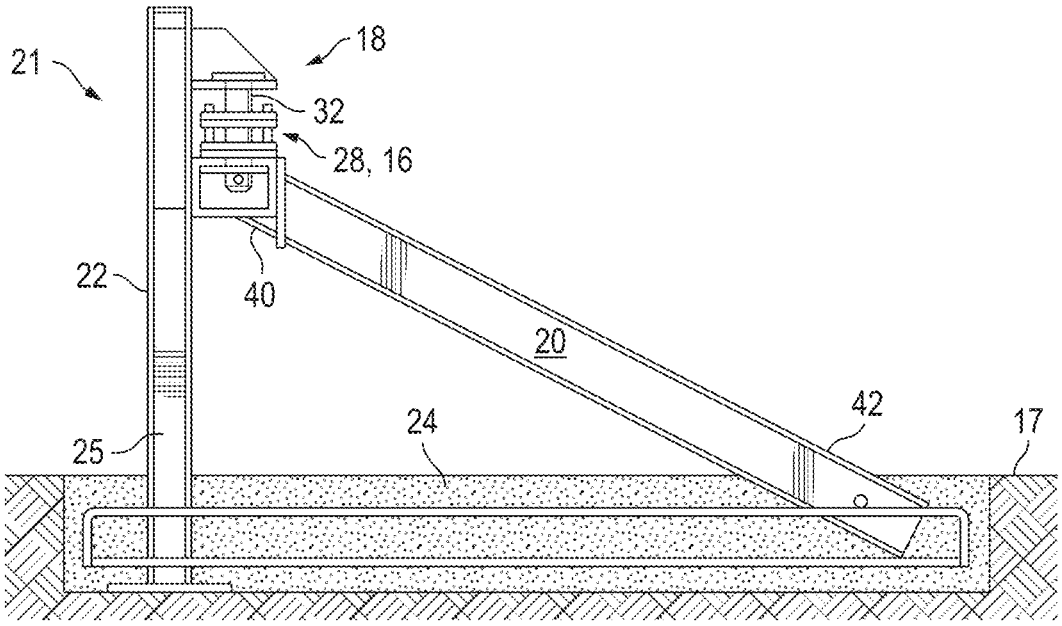
FIG. 7 illustrates an example of a brace that may be connected to a beam at a joint between beam sections.
Figure 8A:
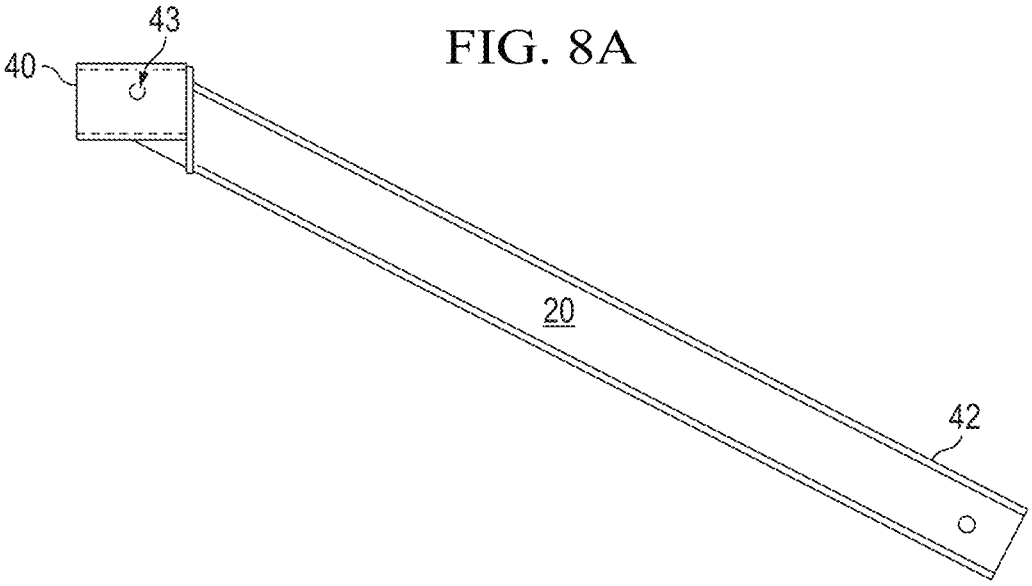
FIGS. 8A and 8B illustrate an example of the brace of FIG. 7.
Figure 8B:
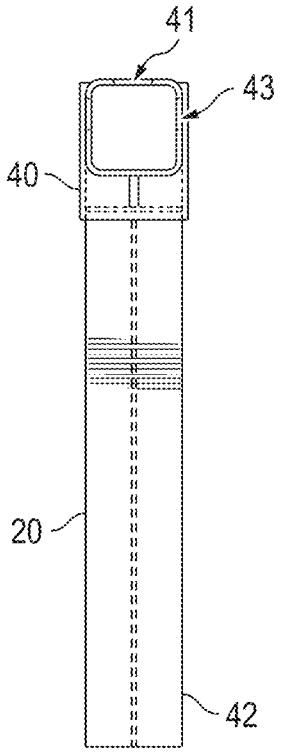

FIG. 7 illustrates an example of a brace 20 that may be connected to beam 12 at a joint 18. With reference also to FIGS. 8A and 8B, brace 20 is, for example, a metal member extending from a first end 40 to a second end 42. First end 40 is connected to adjacent beam sections 16 via pivot pin 32 and second end 42 is disposed in foundation 24. A non-limiting example of a pivot pin 32 is illustrated in FIG. 22. Brace 20 may be constructed for example of an I-beam type member, e.g., W-beam. In this example, foundation 24 is a shallow concrete foundation extending for example about 18 inches or less below the ground level. In some embodiments, foundation 24 is a shallow concrete foundation extending for example about 12 inches or less below the ground level.

In this example, first end 40 is a rectangular shaped member extending horizontally relative to ground level and having a vertical hole 41 through which a tail end of pivot pin 32 is disposed, and a cross-hole 43 that may be aligned with a cross-hole 38 in pivot pin 32 (see, FIG. 22). Beam plates 28 of adjacent beam sections 16 overlap with holes 30 of beam plates 28 (FIG. 5B) coaxially aligned and positioned atop first end 40 of brace 20. Pivot pin 32 is disposed in coaxial holes 30 of beam plates 28 and vertical hole 41 providing a pivoting connection between adjacent beam sections 16 and brace 20. In this configuration, brace 20 in combination with the foundation 24 forms a sled to absorb the force of the impact of the motor vehicle from the attack side. Foundation 24 and brace 20 form two adjacent sides of a vertex having an acute angle 7.

In FIG. 7, a vertical post 22 in a line post 21 configuration is connected with brace 20 and beam 12 at joint 18. Vertical post 22 is a metal member having a bottom end 25 located in foundation 24. In the example of FIG. 7, posts 22 are positioned on the attack side relative to beam 12.

Figure 9A:
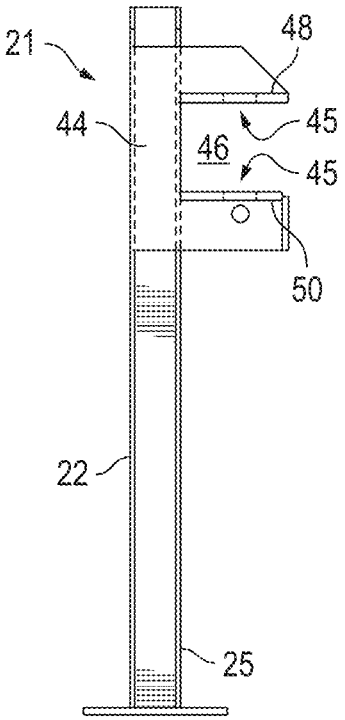
FIGS. 9A and 9B illustrate an example of a line post that may be connected to the brace in FIG. 7.
Figure 9B:
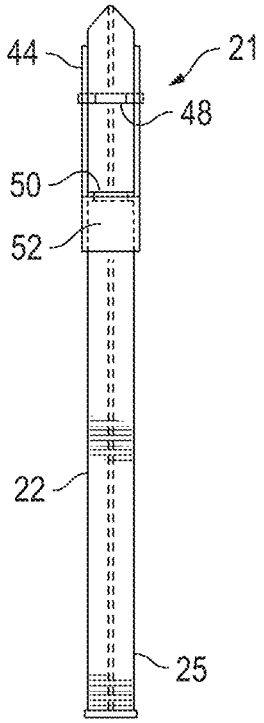

FIGS. 9A and 9B illustrate an example of a post 22 used as a line post 21 in FIG. 7. The illustrated line post 21 includes a C-shaped frame 44 forming a cavity 46 between a top shelf 48 and a bottom shelf 50 and coaxial holes 45 through shelves 48, 50. In this example, bottom shelf 50 is formed by a rectangular member having a pocket 52 sized to dispose first end 40 of brace 20. With reference also to FIGS. 7, 8A and 8B, beam plates 28 of adjacent beam sections 16 are positioned in cavity 46 and first box end 40 of brace 20 is positioned inside of pocket 52. Pivot pin 32 is positioned in coaxial holes 45 of top and bottom shelves 48, 50, vertical hole 41, and holes 30 in beam plates 28. Pivot pin 32 can be secured by positioning a locking member 56 (see, e.g., FIGS. 10 and 14) is coaxially aligned cross-holes 47, 43, 38, in bottom shelf 50, first box end 40, and tail end 36 of pivot pin 32. A tamper resistant connection is formed with the head of the pivot pin flush mounted and the tail of the pivot pin located in the pocket and the first end of the brace.

FIGS. 10-13 illustrate another example of a brace 20 that may be connected with beam 12 at a joint 18. Brace 20 is, for example, a metal member extending from a first end 40 to a bottom end 42 to be disposed in the foundation. Brace 20 may take various forms including being an I-beam, such as a W-beam. In this example, first end 40 includes top shelf or plate 48 and bottom spaced apart plate 50, which have coaxial holes 45 for disposing a pivot pin 32. In use, beam plates 28 of adjacent beam sections 16 are interleaved and disposed between plates 48, 50 of brace 20, and pivot pin 32 is disposed in coaxial holes 45 in plates 48, 50 and holes 30 in beam plates 28 thereby connecting brace 20 to the adjacent beams 16.

Brace 20 may be connected to a line post 21. In the configuration of FIGS. 10-13, beam 12 and posts 22 are aligned substantially in the same vertical plane, as illustrated for example in FIGS. 3 and 4. Post 22 has a bottom end 25 to be disposed for example in the foundation and an upper end 27. Post 22 may take various shapes and is a rectangular member in this example. Beam plates 28 of adjacent beam sections 16 may be connected to or proximate to top end 27. For example, in the illustrated example, bottom plate 50 of the pair of plates forming the first end of brace 20 may be positioned on top of the top end of post 22 or disposed in a slot 33 just below a top end of post 22. A pivot pin 32 may be positioned in the beam plates, the first end of the brace, and connected to post 22. A locking mechanism 56 (FIG. 10) may be disposed through a cross-hole 29 (FIG. 11) in post 22 to secure pivot pin 32 vertically relative to post 22.

Figure 14:
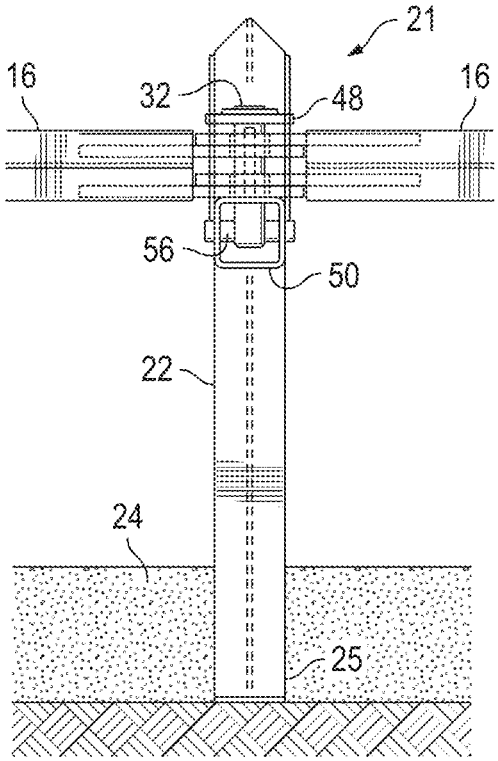
FIG. 14 is an elevation view from the attack side of another example of a brace that may be connected to a beam at a joint between beam sections.
Figure 15:
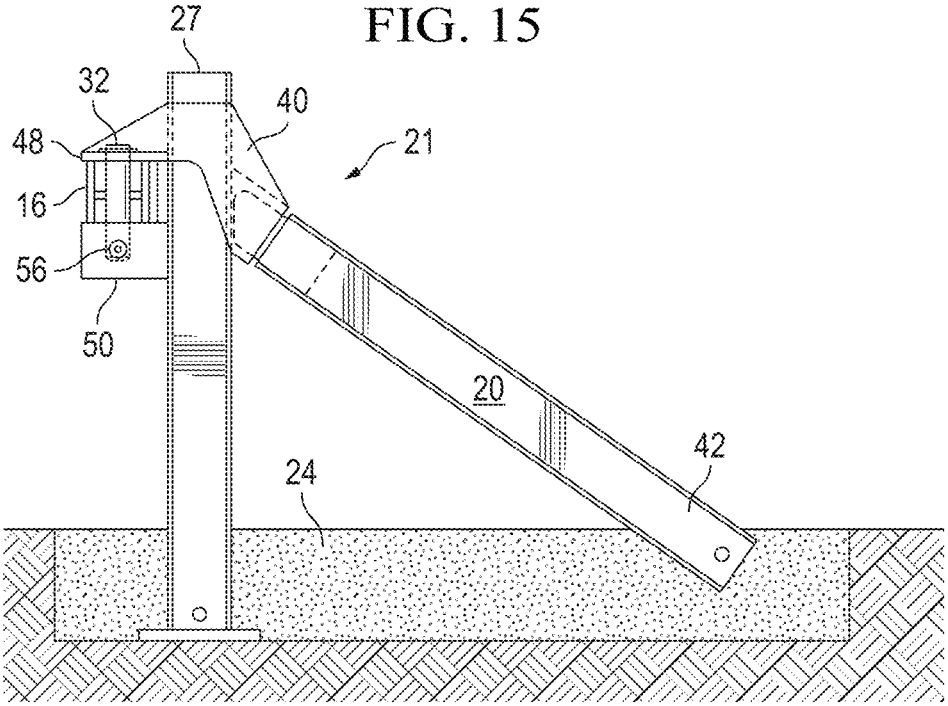
FIG. 15 is a side elevation view of the brace connection of FIG. 14.

FIGS. 14 and 15 illustrate another non-limiting example of a brace 20 that may be connected to beam 12 at a joint 18 and at a vertical post 22 in a line post 21 configuration. Line post 21 extends from a bottom end 25 disposed in a foundation 24 to a top end 27. Brace 20 has a first end 40 configured to be disposed over top end 27 of line post 21 and to connect to beam 12 with line posts 21 located on the protected side of beam 12. A bottom shelf 50 is positioned on the attack side of the post 22. Beam plates 28 of adjacent beam sections 16 are interleaved and positioned atop bottom shelf 50 and between a top shelf 48 of first end 40 of brace 20 and bottom shelf 50. A pivot pin 32 is disposed through the top and bottom shelves and the interleaved beam plates and a locking member 56 is disposed through cross-hole 38 (FIG. 22) in pivot pin 32. Similar to FIG. 7, bottom shelf 50 may form a pocket in which the tail end of the pivot pin is located to provide resistance to tampering with the connection.

Figure 16:
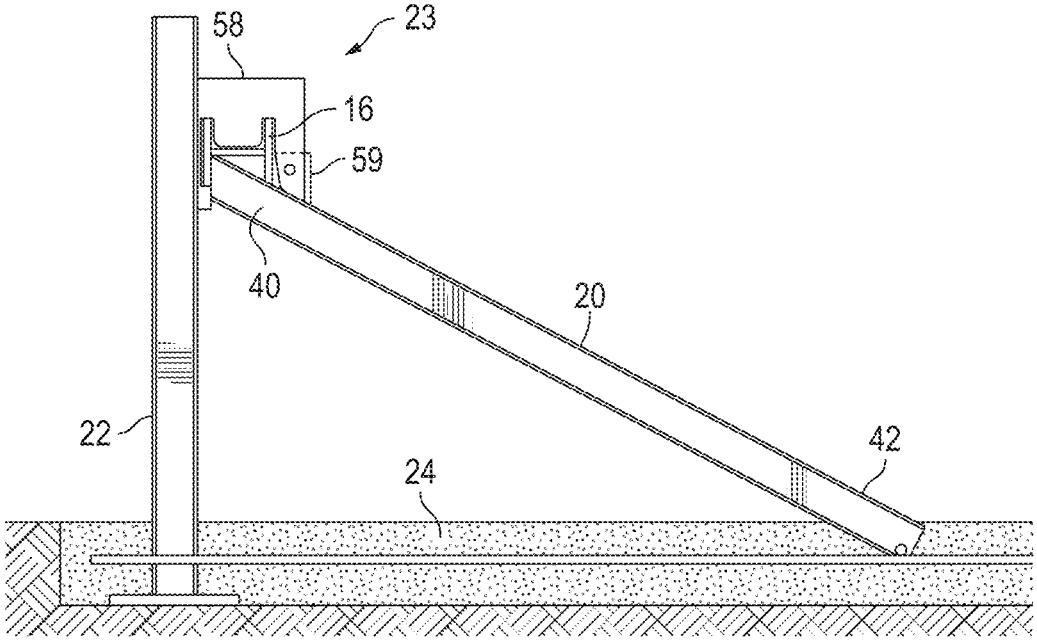
FIG. 16 is an elevation view of a brace that may be connected to a beam at an intermediate position.
Figure 17:
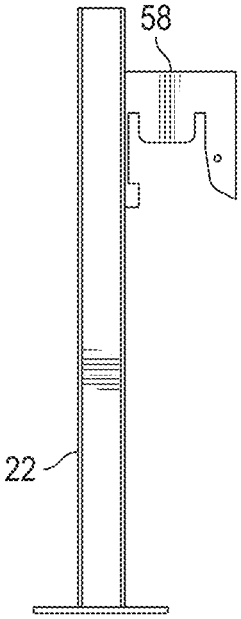
FIG. 17 illustrates an example of an intermediate post that may be connected to the beam and/or the beam and a brace.
Figure 18:
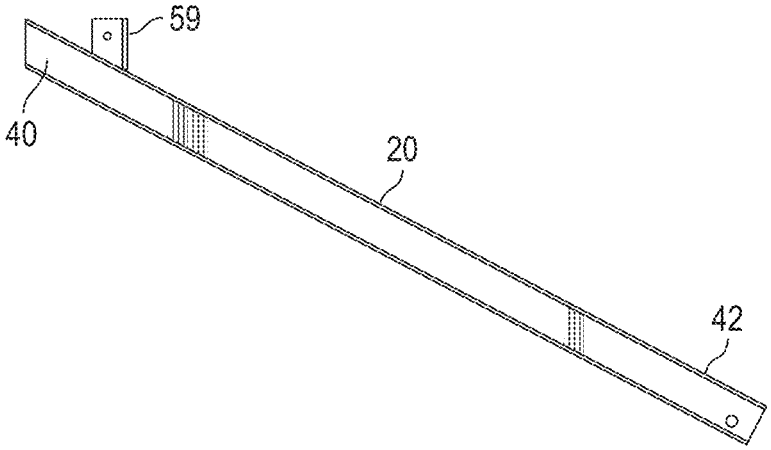
FIG. 18 illustrates the brace of FIG. 16.

FIG. 16 illustrates an example of a brace 20 that may be connected to beam 12 at an intermediate position. Brace 20 may be attached to a post 22 in an intermediate post 23 configuration as illustrated in FIG. 16. With additional reference to FIGS. 17 and 18, intermediate post 23 has a bracket 58 located for example on the protected side to connect to a beam section 16. Bracket 58 includes a W-pattern to be positioned atop a W-shaped (e.g., wide flange beam) I-beam section 16 as illustrated in FIG. 16. Brace 20 has a bracket 59 to connect to post bracket 58 and that is positioned a distance away from first end 40 so that first end 40 can be positioned under beam section 16.

Figure 10:
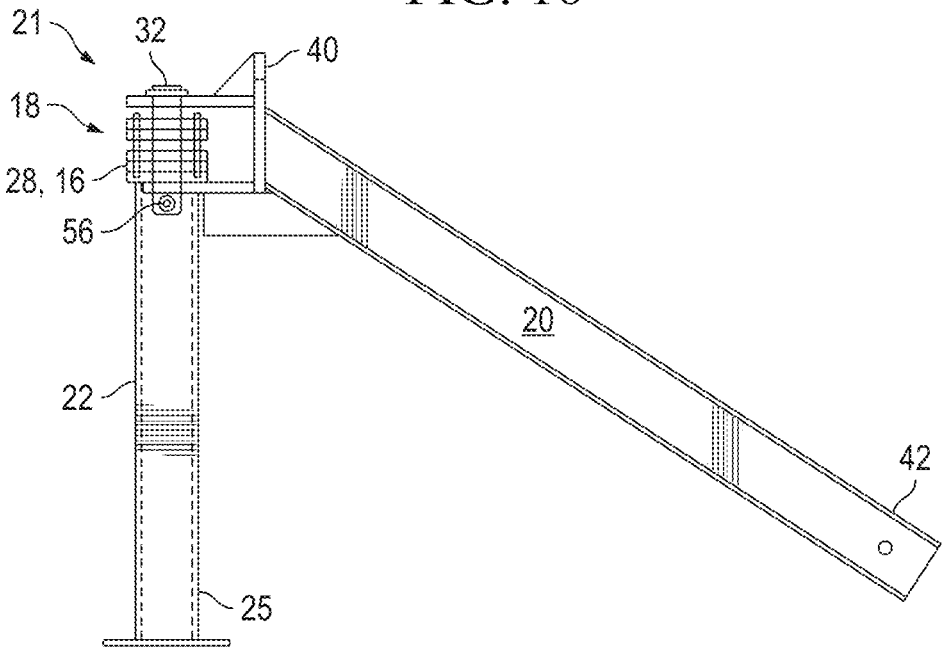
FIG. 10 is an elevation view of an example of a brace that may be connected to a beam at a joint between beam sections.
Figure 11:
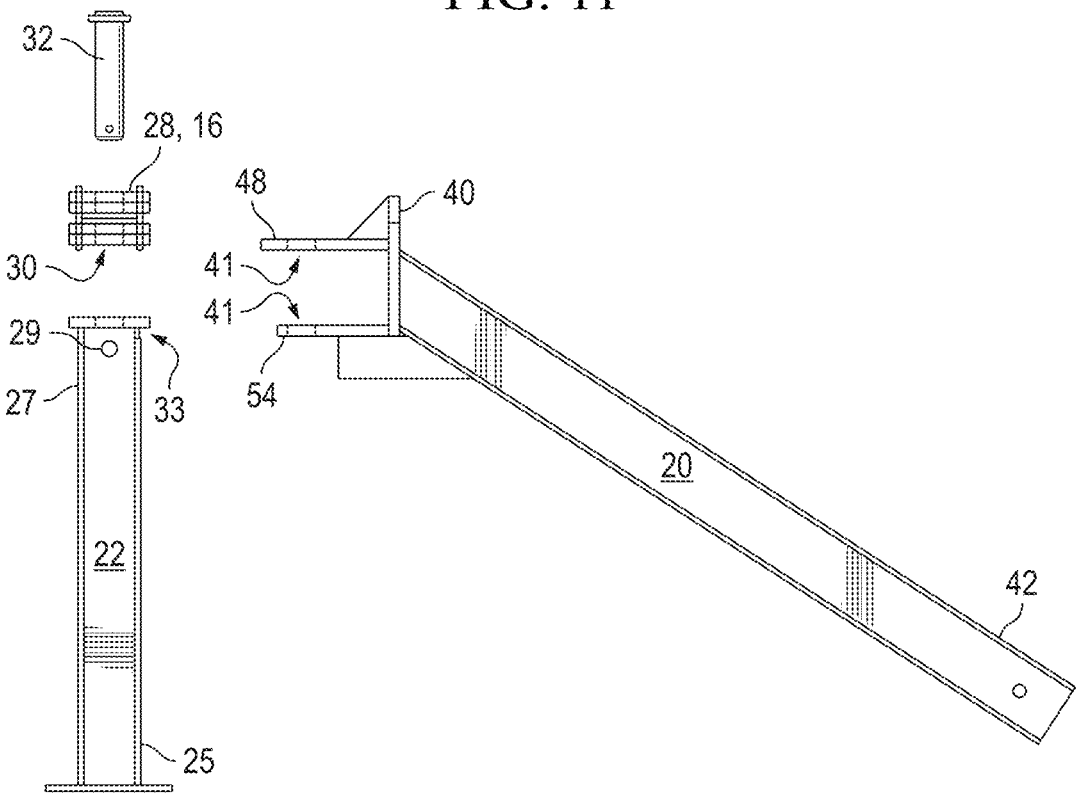
FIG. 11 is an exploded elevation view of the brace connection of FIG. 10.
Figure 12:
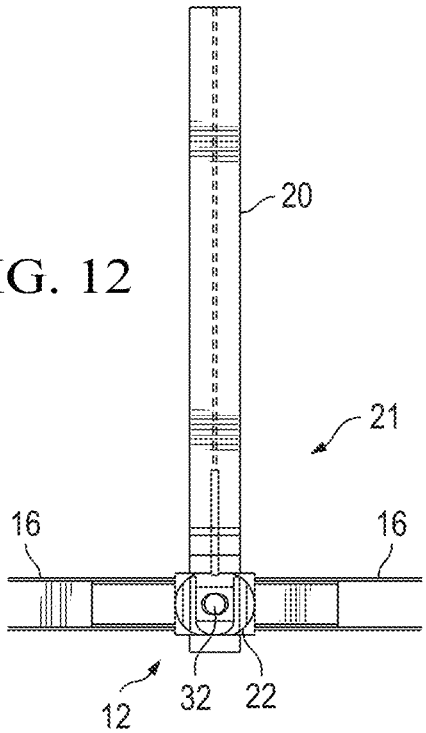
FIG. 12 is a plan view of the brace connection of FIG. 10.
Figure 13:
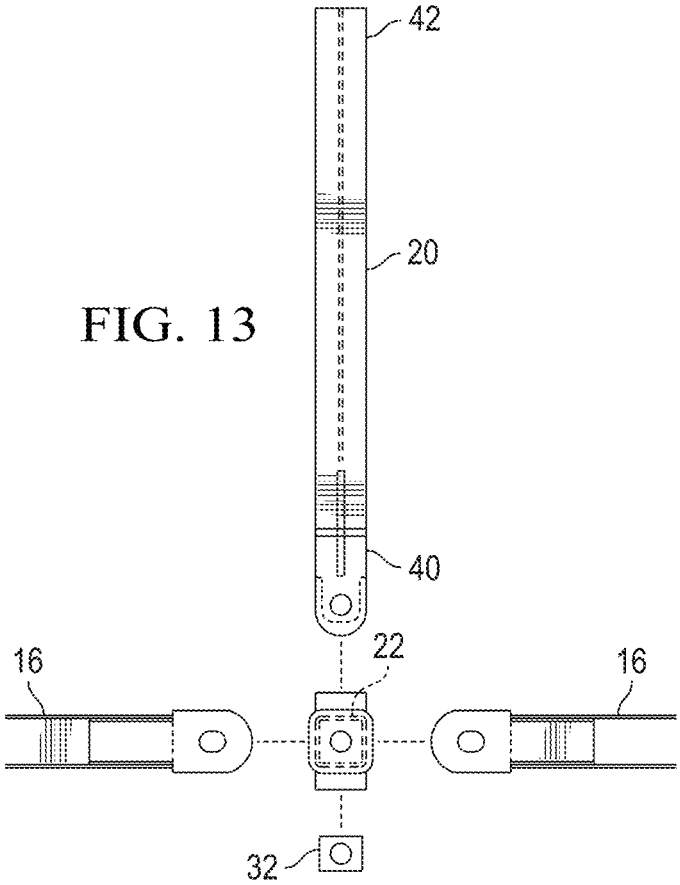
FIG. 13 is an exploded plan view of the brace connection of FIG. 10.
Figure 19:
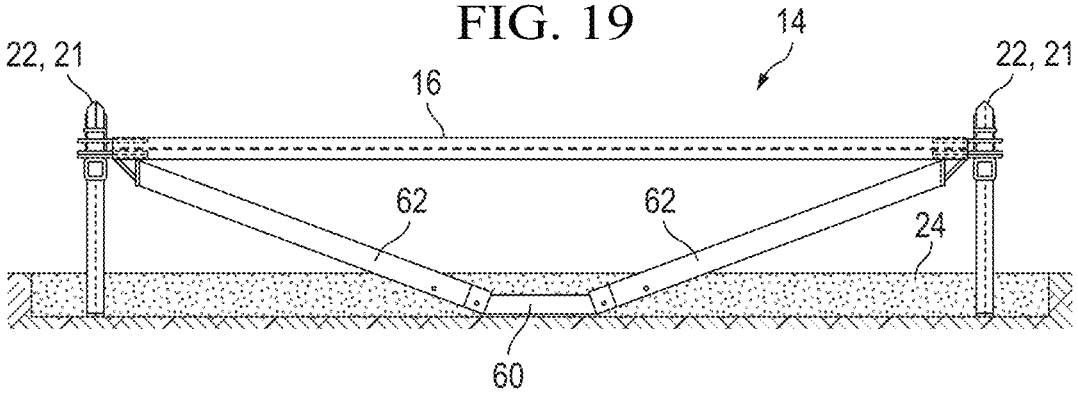
FIGS. 19 and 20 illustrate examples of truss sections according to aspects of the disclosure.
Figure 20:
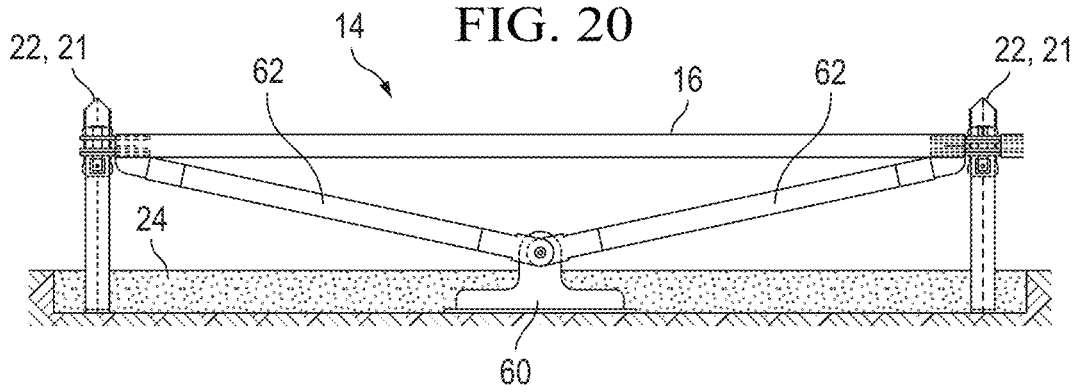

FIGS. 19 and 20 illustrate examples of truss sections 14 having a push-pull design according to aspects of the disclosure, described with additional reference to FIGS. 1-4. Truss section 14 has spaced apart posts 22, which may be in a line post 21 configuration. In a non-limiting example, truss section 14 may include braces 20 at one or more of posts 21 for example as illustrated in FIG. 7 or FIG. 10. A horizontal beam section 16 is connected between posts 22 of truss section 14. A truss anchor 60 is secured in the foundation proximate the center point between posts 22 in truss section 14. One truss beam 62 is connected to one post 22 and truss anchor 60 and a second truss beam 62 is connected to the other post 22 and truss anchor 60.

Figure 21:
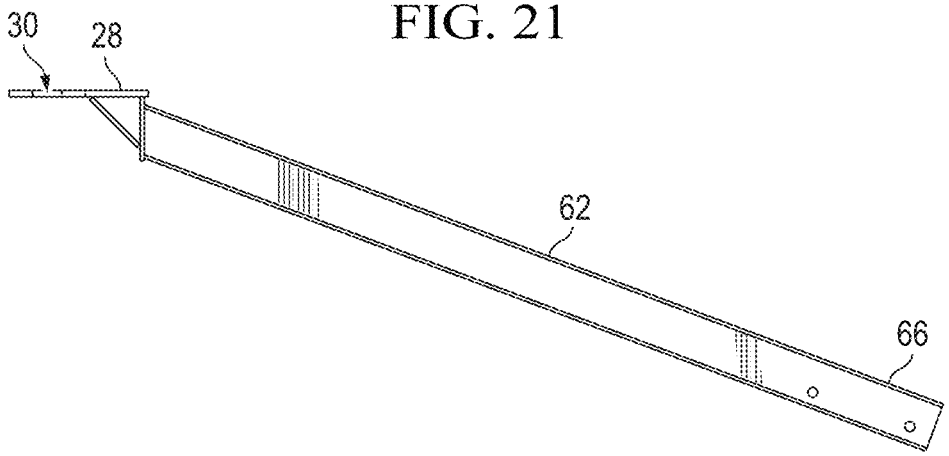
FIG. 21 illustrates an example of a truss beam according to aspects of the disclosure.

FIG. 21 illustrates an example of a truss beam 62 according to an embodiment. Truss beam 62 has a first end 64 having a beam plate 28 with a hole 30 and a second end 66 configured for connecting to truss anchor 60. In the example illustrated in FIG. 19, the second ends of the truss beam are disposed in the foundation 24.

FIG. 22 illustrates an exemplary pivot pin 32 having a head 34 opposite a tail end 36. In some embodiments, tail end 36 has a cross-hole 38, for example, to dispose a locking member, see e.g. FIG. 14.

A passive vehicle barrier according to at least one embodiment includes a plurality of interconnected beam sections, forming a beam positioned above ground level and secured to the ground via a plurality of spaced apart posts. Adjacent beam sections are pivotally connected to one another. In some embodiments, the passive vehicle barrier is an anti-ram barrier is configured to meet or meets ASTM F2656 standards. The posts may be positioned at pivotal connections between adjacent beam sections and/or positioned between pivotal connections.

In some embodiments, braces can be attached to the beam and the ground to form two sides of a triangle and provide a stopping force to a motor vehicle impacting the beam. One or more of the braces may be connected with a vertical post that forms a third side of the triangle.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A vehicle barrier, comprising:

a beam extending longitudinally between opposing end posts, the longitudinally extending beam positioned vertically above a ground level and separating a protected side from an attack side, the beam comprising beam sections;

a line post positioned in a same vertical plane as the beam and supporting the beam off of the ground level, the line post comprising an I-beam with a central web;

a beam connector plate having a first vertical hole and a second vertical hole, the beam connector plate disposed through the central web positioning the first and the second vertical holes on opposite sides of the central web; and adjacent beam sections pivotally connected to the beam connector plate on opposite sides of the central web.

2. The vehicle barrier of claim 1, wherein the vehicle barrier has an M50 designation in accordance with ASTM F2656.

3. The vehicle barrier of claim 1, wherein the vehicle barrier has an ASTM F2656 M50-P1 designation.

4. The vehicle barrier of claim 1, wherein the vehicle barrier has an ASTM F2656 M40-P2 designation.

5. The vehicle barrier of claim 1, wherein the beam is positioned approximately three feet above the ground level.

6. The vehicle barrier of claim 1, wherein the beam sections have a length of approximately twenty feet or greater.

7. The vehicle barrier of claim 1, wherein each of the adjacent beam sections is connected to the beam connector plate by a pin extending between the beam connector plate and a pair of vertically separated plates, wherein the beam connector plate is located between the pair of vertically separated plates.

8. The vehicle barrier of claim 7, wherein the beam sections have a length of approximately twenty feet or greater.

9. The vehicle barrier of claim 1, wherein the adjacent beam sections that are pivotally connected to the beam connector plate comprise a first beam section and a second beam section;

the first beam section having one terminal end pivotally connected to the beam connector plate at the line post; and the first beam section having an opposite terminal end pivotally connected to another second beam section at a second line post.

10. The vehicle barrier of claim 1, wherein the adjacent beam sections that are pivotally connected to the beam connector plate comprise a first beam section and a second beam section;

the first beam section comprising a first connector plate having a first aperture aligned with the first vertical hole;

a first pin disposed in the first aperture and the first vertical hole;

the second beam section comprising a second connector plate having a second aperture aligned with the second vertical hole; and a second pin disposed in the second aperture and the second vertical hole.

11. The vehicle barrier of claim 10, wherein the first connector plate and the second connector plate are positioned above the beam connector plate.

12. The vehicle barrier of claim 11, wherein the first aperture and the second aperture are square and the first and the second vertical holes are round.

13. The vehicle barrier of claim 10, wherein the beam sections have a length of about twenty feet or greater.

14. The vehicle barrier of claim 10, wherein the beam is positioned approximately three feet above the ground level.

15. The vehicle barrier of claim 14, wherein the beam sections are I-beams having a length of approximately twenty feet or greater.

16. The vehicle barrier of claim 10, wherein the first connector plate and the second connector plate each comprise a pair of vertically separated plates, wherein the beam connector plate is located between the pair of vertically separated plates.

17. The vehicle barrier of claim 10, wherein the vehicle barrier has an M50 designation in accordance with ASTM F2656.

18. The vehicle barrier of claim 17, wherein the beam is positioned approximately three feet above the ground level; and the beam sections have a length of approximately twenty feet or greater.

19. The vehicle barrier of claim 10, wherein the first beam section comprises a first terminal end and a second terminal end;

the first connector plate extends from the first terminal end of the first beam section; and the second terminal end is pivotally connected to another second beam section at a second line post.

20. The vehicle barrier of claim 19, wherein the first beam section has a length of twenty feet or greater.

* * * * *